US005294015A

United States Patent [19]

Landis

[11] Patent Number: 5,294,015

[45] Date of Patent: Mar. 15, 1994

[54] EASY-OPEN LID

[75] Inventor: H. Richard Landis, Oak Lawn, Ill.

[73] Assignee: Landis Plastics, Inc., Chicago Ridge, Ill.

[21] Appl. No.: 887,971

[22] Filed: May 22, 1992

[51] Int. Cl.[5] ..... B65D 41/16

[52] U.S. Cl. ..... 220/306; 220/266; 220/277

[58] Field of Search ..... 220/265, 266, 277, 284, 220/306, 308, 339

[56] References Cited

U.S. PATENT DOCUMENTS

| | | | |
|---|---|---|---|
| 389,954 | 9/1888 | Cheswright | 215/256 |
| 1,540,303 | 6/1925 | Anderson | 215/256 |
| 2,742,171 | 4/1956 | Meader et al. | 215/293 |
| 3,519,163 | 7/1970 | Bardell | 220/306 |
| 3,773,207 | 11/1973 | Dokoupil et al. | 220/270 |
| 3,811,597 | 5/1974 | Frankenberg | 220/306 X |
| 3,812,994 | 5/1974 | Feldman | 215/256 |
| 3,930,593 | 1/1976 | Ragettli | 220/276 |
| 4,055,267 | 10/1977 | Blair | 215/254 |
| 4,457,447 | 7/1984 | Kirkis | 220/306 |
| 4,500,010 | 2/1985 | Schütz | 220/320 |
| 4,570,897 | 2/1986 | Von Holdt | 249/144 |
| 4,682,706 | 7/1987 | DeVore et al. | 220/276 |
| 4,711,364 | 12/1987 | Letica | 220/276 |
| 4,735,337 | 4/1988 | Von Holdt | 220/276 |
| 4,819,825 | 4/1989 | Landis | 220/276 |
| 4,966,302 | 10/1990 | Hjordie | 220/306 |

FOREIGN PATENT DOCUMENTS

| | | |
|---|---|---|
| 204942 | 8/1959 | Austria . |
| 3233805A1 | 3/1984 | Fed. Rep. of Germany . |
| 1335722 | 10/1973 | United Kingdom . |

*Primary Examiner*—Allan N. Shoap
*Assistant Examiner*—Nova Stucker
*Attorney, Agent, or Firm*—Fitch, Even, Tabin & Flannery

[57] ABSTRACT

A large easy opening plastic lid, such as for a five gallon paint can, having a peripheral flange with an annular locking ring that engages an annular bead on a container sidewall to retain the lid in sealed engagement with the container. The flange is formed with a plurality of peripherally spaced frangible lines of weakness, which, when broken, segment the peripheral flange into separate flange segments, each having a segment of the locking ring. Following rupture of the flange along the frangible lines of weakness, each of the flange segments is independently pivotable between two positions, a first lowered position in which the respective segments of the locking ring engage with the container bead to securely retain the lid on the container, and a second raised or winged position in which all of the respective segments of the locking ring are disengaged from the container bead to facilitate easy removal and replacement of the lid. The lid is reapplied to the container by forcing the flange segments radially inward to a position beneath the locking bead to hold the lid to prevent splashing of the container contents.

16 Claims, 4 Drawing Sheets

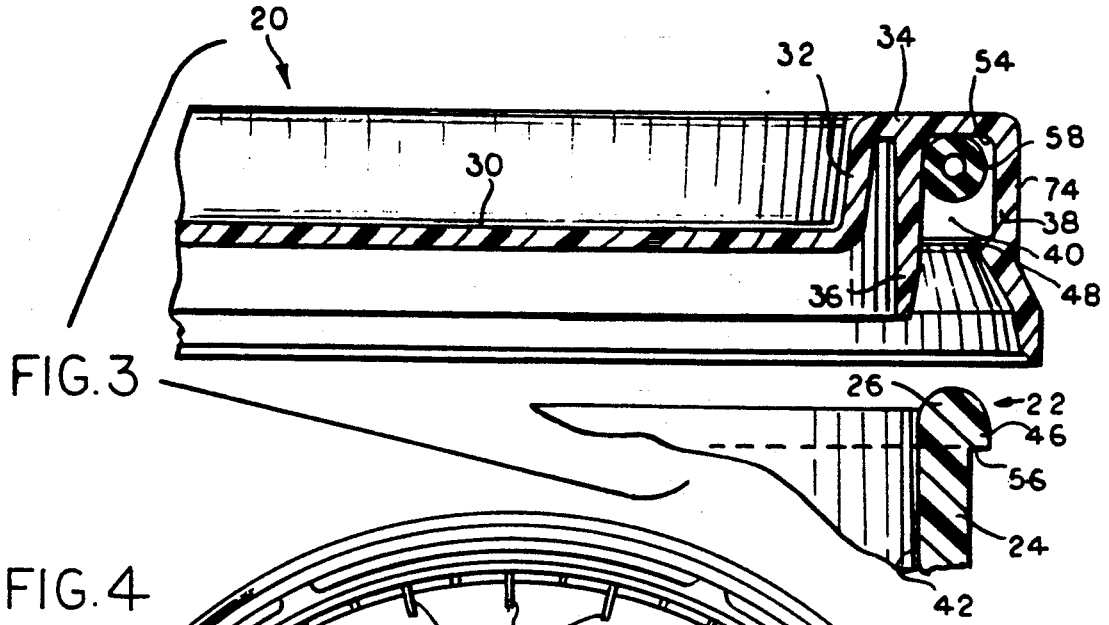
FIG. 3
FIG. 4
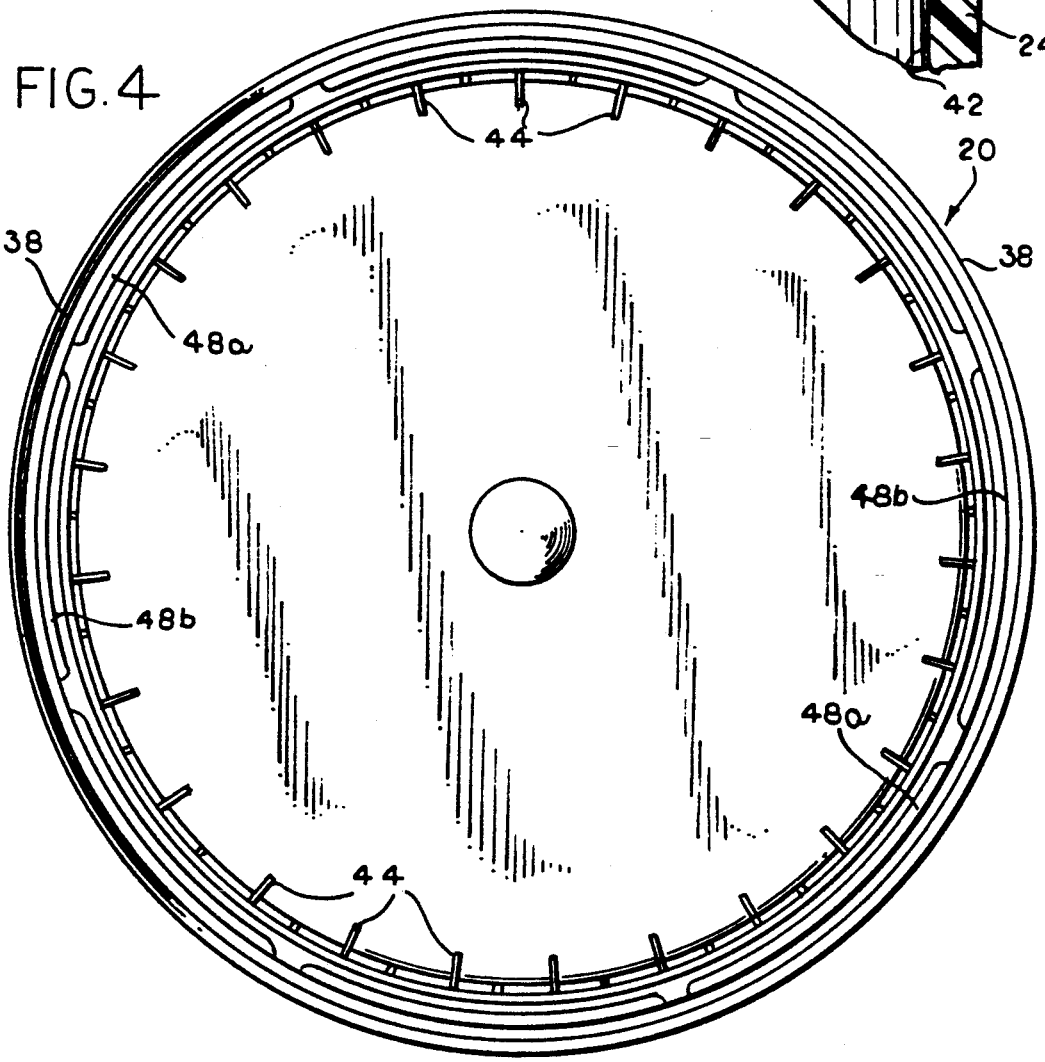

EASY-OPEN LID

The present invention relates generally to molded plastic lids for use as closures for plastic containers and specifically to a molded plastic lid for providing a sealed closure which may be easily removed following rupture of the peripheral skirt and may be reattached to the container.

BACKGROUND OF THE INVENTION

There are currently produced large five gallon molded plastic lids for use with five gallon containers filled with various contents, often liquid contents such as paint. These large lids are relatively strong in that the plastic used therein must support the weight of a series of stacked containers thereabove during warehousing or transporting. The weight can be as much as four hundred pounds. These lids are provided with relatively thick and strong skirts or peripheral flanges that have a locking ring engaging a locking bead on the container. A typical drop test is to drop a fully loaded container four feet and then to test for the integrity of the lid and its seal with the container. Such container lids are often 12 inches in diameter. The lid usually contains slots or areas of weakness in the skirt flange for breaking of the lid into a plurality of segments. Often, slots in the form of screw driver slots are present in the outer surface of the skirt flange and a screw driver is forced into a slot and used as a lever to fracture the skirt flange into a plurality of segments each of which still has a locking ring segment in full locking or sealing engagement with the container bead. With considerable exertion of force, several of the flange segments are pried outwardly to shift radially outwardly their associated locking ring segments and these flange segments are bent upwardly to cam their locking ring segments across the container bead. Then, the remainder of the lid is bent and rolled and pried to cause the other locking ring segments to slide across and over the locking bead until the lid is freed. Tools such as pliers are often used to pull and pry the flange segments outwardly and to peel their locking ring segments across the container retention bead. Such lids are difficult to remove even with tools.

U.S. Pat. No. 4,735,337 proposes an easier opening lid than above-described by providing a tear strip that removes one half of the flange segments which then must be pried over the container bead. In a second embodiment of this '337 patent, half of the flange segments are pivoted upwardly about a line of weakness, while the other half of the flange segments without a line of weakness remain in engagement with the container bead. The removal of the lid requires the simultaneous outward deflection of these remaining flange segments, while at the same time lifting up on the lid. The outward deflection must be sufficient to disengage the gripping locking ring portions from the annular bead or shoulder provided on the outer periphery of the upper edge of the container wall.

Upon reuse of the above described lid of the '337 patent, the lid is forced back on to the container with sufficient force to deflect the remaining flange segments outwardly whereby the gripping locking ring portions may reengage with the underside of the shoulder or bead on the container. Because of the large diameter of such plastic lids, it is difficult to overcome the friction associated with the engaging cylindrical surfaces on the container and lid in replacing the lid to its sealed position. The force associated with deflecting the remaining flange segments in replacing the lid adds significantly to the problem of reattaching the lid. In addition, there is often dried paint or other container contents that may have been deposited on these engaging surfaces of the lid and container that are likely to increase the force necessary to reattach the lid to the container.

It is also difficult to determine when or if the lid has been forced down sufficiently to reengage the gripping projections under the bead. If such reengagement is not accomplished, there will not be an acceptable seal formed between the lid and the container.

Another patent showing the use of a plastic lid having peripherally spaced fold-out flange portions is Blair U.S. Pat. No. 4,055,267. The Blair patent would not be suitable for providing a resealable positive seal.

SUMMARY OF THE INVENTION

The present invention involves a molded plastic lid which is adapted for easy removal from a container and may be reattached easily to reseal with a container such as a plastic paint container. The lid includes a downwardly extending peripheral flange or skirt having an inwardly directed annular projection or locking ring that engages beneath a shoulder or bead on the container wall to retain the lid in sealed engagement with the container. The peripheral flange is formed with a plurality of peripherally spaced frangible lines of weakness therein, which extend vertically substantially along the height of the flange or skirt. Hence, the flange is frangible at discreet peripherally spaced locations along these peripherally spaced vertical lines of weakness, to segment the flange into a plurality of separate arcuate flange segments. Preferably, the peripheral flange or skirt is also formed with an annular line of weakness defining a hinge line in the interior surface thereof. The hinge line is formed in the peripheral flange to allow each flange segment to be pivoted radially outwardly to move its associated locking ring portion radially outwardly relative to its initial locking position. Thus, after the peripheral flange has been severed and segmented along the frangible lines of weakness therein each of the arcuate flange segments is pivoted outwardly along its hinge line so that all of the locking ring segments are shifted outwardly, thereby making the lid easier to remove.

Thus, it will be seen that as a consequence of each of the flange segments being folded with the locking ring or projection segments being disengaged from the container bead, the lid may be easily removed from the container, without the necessity of overcoming the lid retaining forces operating between the annular bead of the container sidewall and the projection segments of the lid, as required in lids of the prior art.

The lid is adapted to being reattached to the container and to preferably reestablish a seal therewith. With each of the peripheral flange or skirt sections being folded upwardly, there is little resistance to replacing the lid with the lid being seated against the upper edge of the container sidewall. Following seating of the lid on the container, the plurality of flange segments may then be sequentially folded downwardly to the original position to reengage the projection segments of the respective flange segments with the bead of the container and thus maintain the desired seal between the lid and the container.

The flange segments each remain hingeably connected to the lid by an integrally molded, elongated strip of reduced thickness which extends along an arc. As a consequence of the arc shape, the flange segments may be positioned in either of two stable positions, a sealing position extending downwardly and a release position extending outwardly of the lid flange. Upon removal of the lid, the foldable flange portions are positioned in the release position in which they are completely disengaged from the annular shoulder or bead on the upper end of the container sidewall. Upon replacement of the lid in sealing engagement with the container, the flange segments are forced downwardly to the sealing position to retain the lid.

Any failure to displace the lid to the sealed position will be reflected in the foldable segments being rotated outwardly from the sealing position. This displaced position of the segments is obvious from a visual standpoint, informing the user that he has not yet positioned the lid to achieve the desired seal. The user may force the displaced flange segment radially inward. Because of the stressing of the plastic, the flange segments will not return fully inward to their original positions but will return sufficiently.

In accordance with one aspect of the invention, the integrally molded hinge comprises an annular hinge groove or line of weakness formed in the interior surface of the peripheral flange. More particularly, the groove extends into the interior surface of the peripheral flange substantially normal thereto to facilitate pivotal movement of the flange segments between lowered and outward positions. The lower end of the hinge groove is curved smoothly into the interior surface of the peripheral flange to facilitate stripping of the mold in which the lid is formed. Herein, the groove is rounded in cross section rather than having a V-shape because a V-shape tends to concentrate stresses to break the flange during a drop test. A balance is needed between the desire for a thin plastic cross section at the hinge line to allow easy pivoting of a flange segment and a thick cross section at the hinge line to provide strength to prevent fracture of the hinge line plastic in a drop test.

Accordingly, it is an object of the present invention to provide an improved plastic lid for a container which positively seals with the container in a secure fashion capable of withstanding standardized drop tests, and which may be removed from the container by first breaking the skirt or flange of the lid along discreet, peripherally spaced, frangible lines of weakness to separate the flange into a plurality of flange segments, and then independently folding each of the flange segments outwardly to release positions. The container may thereafter be reengaged or resealed by sequentially folding each of the flange segments back to their sealing positions.

BRIEF DESCRIPTION OF THE DRAWINGS

These and other objects and advantages of the invention will become apparent from the following detailed description taken in conjunction with the accompanying drawings in which like elements are referenced alike:

FIG. 3 is a partial, enlarged cross-sectional view of the lid taken along line 3—3 of FIG. 2;

FIG. 4 is a bottom plan view of the plastic lid of FIG. 1;

DETAILED DESCRIPTION OF THE PREFERRED EMBODIMENT

Figure 1:
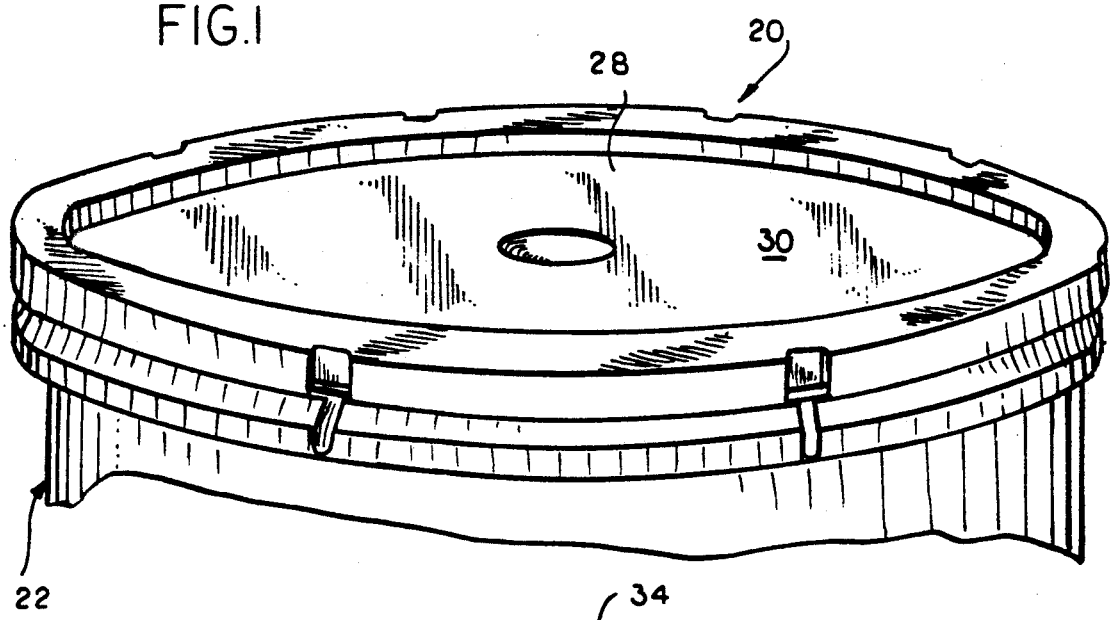
FIG. 1 is a perspective view of a resilient plastic lid embodying various features of the present invention.

Referring to the drawings, there is shown a resilient plastic lid embodying various features of the invention and designated generally by reference numeral 20. The lid 20 is intended for use with large plastic containers used for paint, food product, or other liquid materials but would have broad application to any containers which require sealing of the contents and where the lid is to be used to reseal the container after it has been opened. The illustrated embodiment of the invention is a lid used to seal a five gallon paint container and is about twelve inches in diameter. The lid 20 would be applied to a container 22 having a sidewall 24 which terminates at an upper edge 26 as shown in FIGS. 3, 10 and 11.

The lid 20 is formed of a resilient plastic material and includes a circular body portion 28 which has a central disc portion 30 and is formed at its outer edge with upturned flange 32 and a ring 34. The ring 34 is disposed in spaced parallel relation to the central disc portion 30. Depending from ring 34 of the body portion are two coaxially disposed, generally cylindrical flanges or skirts including an inner sealing flange 36 and an outer peripheral flange 38. The flanges 36 and 38 together with the ring 34 form a downwardly facing annular channel 40 which receives the upper edge 26 of the container sidewall 24 to seal the container 22. The inner flange 36 has a close frictional engagement with the inner surface 42 of the sidewall 24 and serves to add rigidity and strength to the lid 20. In this regard, there are provided a plurality of webs or ribs 44 which extend radially inwardly from the inside surface of the inner flange 36 to the disc portion 30 and the upstanding flange 32. The webs 44 are molded integrally with the lid 20 as are the flanges 36 and 38. One of the purposes of the peripheral flange 38 is to engage the upper edge 26 of the container sidewall 24, and particularly the radially outwardly protruding annular bead 46 formed integrally at the upper edge 26 of the container 22, to lock the lid 20 downwardly against the container sidewall 24.

For the purpose of retaining the lid in a sealed position on the container, the lid is provided with a retaining ring in the form of a projection which protrudes radially inwardly from the inside diameter of the outer flange 38. Although the projection 48 may be continuous, it is preferred that, as in the disclosed embodiment, the projection 48 is made up of a plurality of spaced segments 48*a* and 48*b* as best shown in FIG. 4. While the length and number of the segments 37*a* and 37*b* may vary, in the disclosed embodiment there are four of the segments 37*a* which are separated by segments 37*b*.

Figure 7:
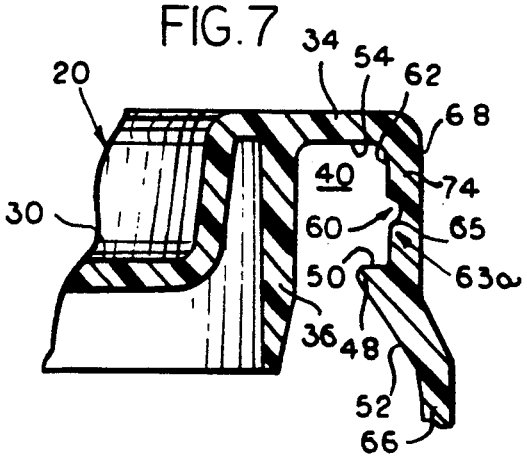
FIG. 7 is an enlarged fragmentary sectional view of the lid, illustrating a lid flange section in its lowered position.
Figure 6:
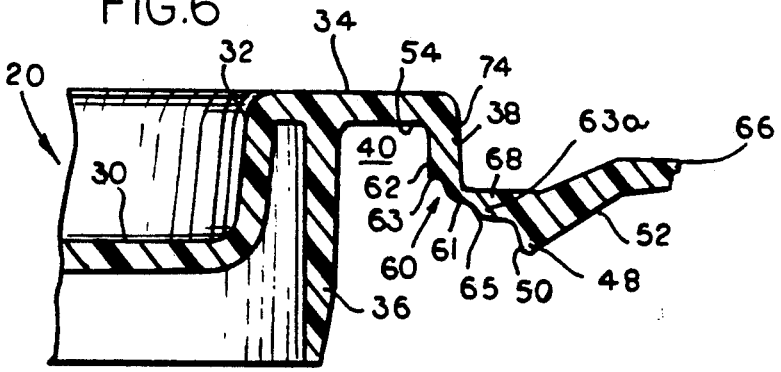
FIG. 6 is an enlarged fragmentary sectional view of the lid of FIG. 1, illustrating a lid flange section in its outward position; .
Figure 8:
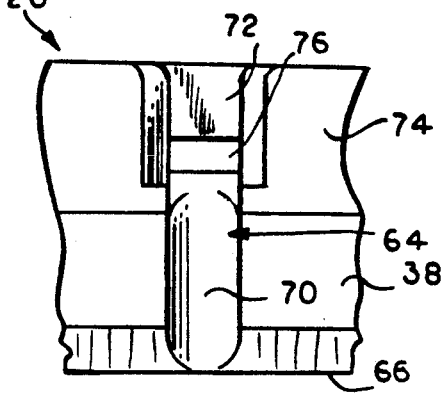
FIG. 8 is an enlarged fragmentary view of a frangible line of weakness of the lid of FIG. 1.
Figure 9:
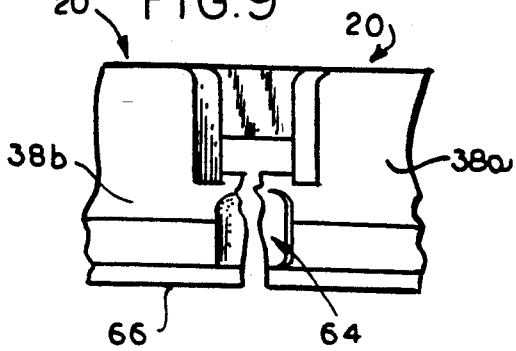
FIG. 9 is an enlarged fragmentary view of the frangible line of weakness of FIG. 8, shown following its rupture and with the flange section moved outwardly.
Figure 10:
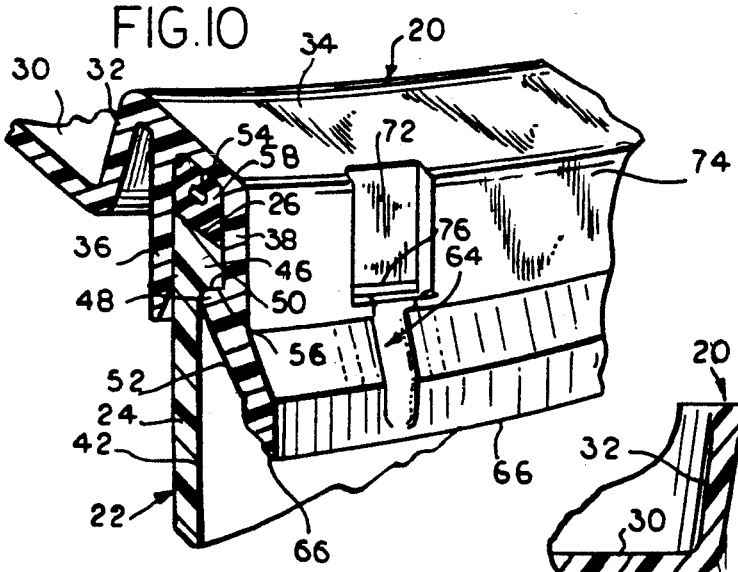
FIG. 10 is an enlarged, fragmentary perspective and sectional view of the lid of FIG. 1, shown engaged with a container.
Figure 11:
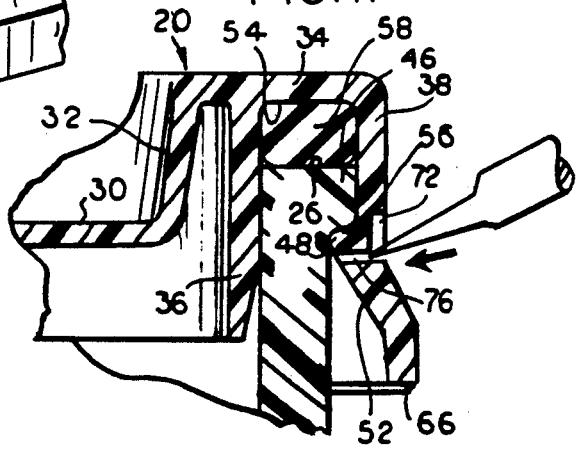
FIG. 11 is an enlarged fragmentary elevational and sectional view of a lid and container engagement of an alternative embodiment lid which does not have a lower frangible line of weakness portion.

The annular projection 48 is wedge shaped in cross section as shown in FIGS. 6, 10 and 11, and best seen in FIG. 7, having a substantially horizontal upper portion 50 and an inwardly angled lower portion or wall 52 extending from the tip of the projection 48 back to the inside wall of the peripheral flange 38. The wide base of the projection 48 on the flange 38 renders it relatively stiff and not subject to any significant deflection as it retains the lid 20 in sealed engagement with the container edge 26.

The distance between the shoulder portion 50 on the annular projection 48 to the underside 54 of the ring 34 is sufficient to accommodate a gasket 58. Thus, when the lid 20 is assembled to the container 22, the flange 38 is in engagement with the annular bead 46 to retain the lower end of the gasket 58 forced against the upper edge 26 of the container sidewall 24 and the gasket is pressed against the underside of the ring 34 to insure a tight, positive seal of the container 22 and the lid 20.

In the assembly of the lid 20 to the container 22, the angled lower portion or wall 52 of the projection 48 bears against the container bead 46 which causes an expansion, or outward movement, of the flange 38 along with the annular projection 48 integral therewith, whereby the annular projection moves downward past the container bead 46, and the upper edge 26 of the container 22 moves to squash the gasket 58. As captured by the annular projection 48 within the channel 40, the upper portion of the sidewall 24 is gripped between the inner and outer flanges 36 and 38, and between the projection 48 and the ring 34 to provide a tight seal. The upper portion of the channel 40 accommodates the rubber gasket 58 which bears against the upper edge 26 of the container 22, when the lid 20 is in sealing engagement with the container 22, to provide the requisite sealing therebetween, as discussed further below.

In the design of a commercially acceptable lid for a container 22 used for paint or the like, it is important that the lid 20 be easily removable by simple tools such as a screw driver. It is also important that the lid 20 be removable in such a manner that it may be reusable to reseal the container 22 if the contents are not completely used immediately after the initial opening of the container. Often painters or other users of other liquids in the container want to replace the lid and transport the container without spilling the liquid contents in the container. Also, they want the lid to be easily removed after such transport.

In order to provide easy removal of the lid 20 from the container 22, the outer peripheral flange 38 is frangible at selective, peripherally spaced locations to divide the flange 38 into a plurality of flange segments 38*a* and 38*b* which are hinged along a groove 60 that defines an annular hinge line 61 about which all the flange segments will be pivoted when moved outwardly to their release positions (FIG. 6). Once the flange 38 has been segmented, each of the flange segments 38*a* and 38*b* are then independently displaceable to non-obstructing winged release positions with respect to the annular bead 46 on the container sidewall 24.

The hinge line 61 facilitates upward movement of the outer peripheral flange segments 38*a* and 38*b* and their respective integral annular projection segments 48*a* and 48*b* to the release position of FIG. 6. The hinge means is preferably an annular groove 60 formed in the inner surface 62 of the flange 38 to provide a thin plastic wall section in the skirt wall. As best illustrated in FIG. 7, the groove 60 is preferably formed in the inner surface 62 of the flange 38 at a height intermediate of the underside 54 of the ring 34 and the substantially horizontal portion 50 of the annular projection 48. This provides a resilient line of weakness along which the flange 38 can be resiliently flexed or bent between raised and lowered positions.

Figure 2:
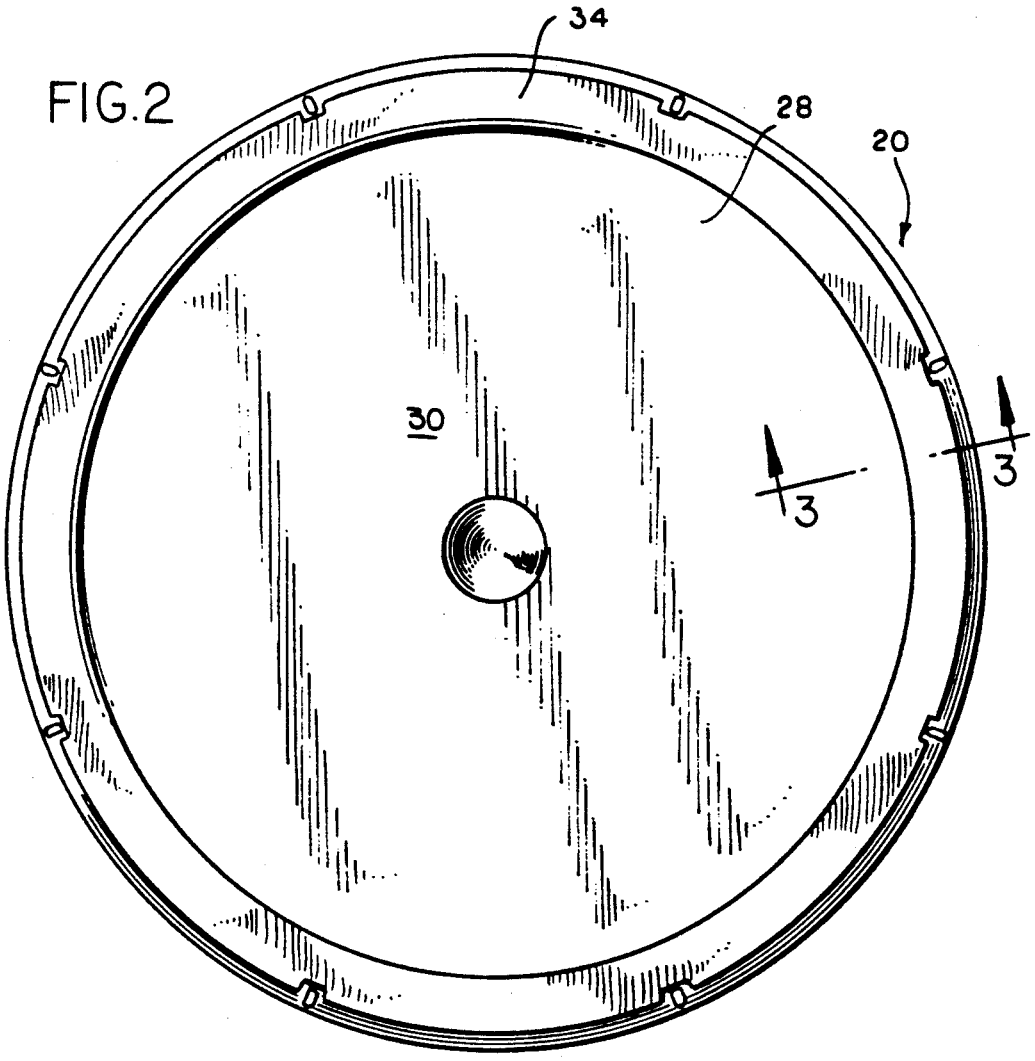
FIG. 2 is a top plan view of the plastic lid of FIG. 1.
Figure 5:
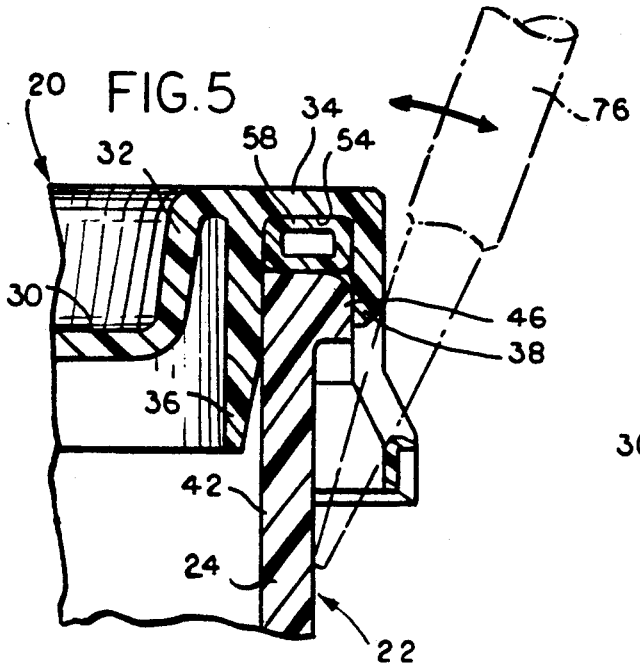
FIG. 5 is an enlarged, fragmentary sectional view of the lid of FIG. 1 illustrating insertion of a tool into a flange aperture to tear the lid flange along one of its frangible lines of weakness, but also showing the sidewall of a container to which the lid is assembled.

The preferred groove 60 is formed with the rounded shape rather than a sharp V-notch as shown in FIG. 2 of U.S. Pat. No. 4,735,337 to overcome the tendency of the V-notch to break when the filled container was dropped in the drop test. The sharp V-notch appears to concentrate the forces to rupture the hinge line whereas the rounded groove 60 does not concentrate the forces and survives the drop test. There is a particular balance needed between the strength needed for the hinge line to survive the drop test and yet a thin enough or flexible enough hinge line that allows the flanges 38 to pivot easily to their winged release position. The present invention has provided such a balance, which could be achieved in other manners, by having a 0.100 inch radius groove 60 on the inside of the flange segment in a 0.090 inch thick wall, the thinnest cross section at the bottom of the groove being 0.035 inch. These dimensions are given by way of example and the present invention is not limited thereto.

In accordance with one aspect of the invention, the annular groove 60 formed in the inner surface 62 of the peripheral flange 38 has an upper portion 63 having the groove 60 with a first radius of curvature and a lower portion 63*a* having corner 65 with a second radius of curvature. The groove 60 extends into peripheral flange 38 substantially normal to the inner surface 62 thereof to provide the thin cross section hinge line 61 (FIG. 6) at which pivot the flange segments 38*a* and 38*b* between their lowered position (see FIG. 7) and their outward winged position (see FIG. 6). The second radius of curvature at the corner 65 at the lower end of the groove 60 is provided to taper the lower corner 65 of the groove 60 smoothly to facilitate release of the lid 20 from the mold in which the lid is formed. By way of example only, good mold release was realized in one lid 20 constructed in accordance with the invention having a radius of curvature of 0.055 inch for the corner 65. The stripper plate (not shown) engages the outer lower edge 66 of the annular flange 38 and pushes it upwardly. The metal in the groove 60 of the mold will hold and catch if a sharp corner rather than the rounded corner 65 is provided when the stripper ring pushes on the flange edge 66.

The frangible lines of weakness 64, along which the outer flange 38 is sheared into separate segments 38*a* and 38*b*, are preferably formed in the outer surface 68 of the flange 38, preferably extending substantially vertically from the annular groove 60 to the lower edge 66 of the flange 38. However, as discussed below, the frangible lines of weakness 64 may, alternatively, be narrow regions of reduced flange thickness. The frangible lines of weakness 64 are spaced peripherally and located in the recesses between each of the adjacent projection segments 48*a* and 48*b*. Accordingly, the frangible lines of weakness 64 define the flange lateral ends of the flange segments 38*a* and 38*b*. Following segmenting of the flange 38 into separate flange segments 38*a* and 38*b* by rupturing the flange 38 at the frangible lines of weakness 64, each of the flange segments 38*a* and 38*b* is pivotal at its upper end along the groove 60 and each flange segment includes a respective integral projection segment 48*a* or 48*b* which pivots together with its associated flange segment 38*a* and 38*b* between obstructing, or engaging, and non-obstructing winged, or disengaged, positions.

Pivotal movement of the flange segments 38*a* and 38*b* to the winged position tends to straighten the arc formed by the hinge groove 60. This straightening of the arc is resisted by the resilience of the plastic material When the flange segments 38*a* and 38*b* are pivoted to the winged position (FIG. 6) the circular arc between edges of each segment is straightened and bent over to an over-center position to hold the segment in the winged position. When the flange is pivoted down again the arc between ends of each segment is again bent back into its previous arcuate shape and into the engaging position shown in FIG. 7. Hence, bending of the arc results in two stable positions of the flange segments 38*a* and 38*b*, with biasing force urging the segments to one or the other on either side of an over-center position. The over-center position exists when a flange segment 38*a* or 38*b* extends outwardly and is moved between its normal inward curvature to a reverse curvature that it maintains while in the non-obstructing, or disengaged, position.

The frangible lines of weakness 64 are formed to be fractured easily by employment of common tools, such as a screwdriver. In the illustrated embodiment, the frangible lines of weakness 64 include a narrow lower portion 70 in communication with a widened upper portion 72. The widened upper portion 72 comprises a rectangular region recessed into the vertical wall 74 of the outer peripheral flange 38.

A slotted aperture 76 is provided in the upper, recessed region 72 of the frangible line of weakness 64 into which the leading end of a tool 78, such as a screwdriver, knife, or the like, is insertable, as shown in FIG. 11, to pry the flange 38 apart along the remaining lower portion 70 of the frangible line of weakness 64. The slotted aperture 76 may be rectangular as illustrated, or may come to a point at its lateral sides to provide regions of stress concentration. The recessed upper portion 72 of the frangible line of weakness 64 serves as a guide to direct the leading end of the tool 76 into the aperture 76. Following tool insertion into the slotted aperture 76, the flange 38 is pried radially outwardly by the tool 78 with sufficient force to sever the flange 38 along the corresponding frangible line of weakness. The mechanical advantage realized by the lever action of the tool 78, together with a portion the flange 38 being weakened by the formation of a frangible line of weakness 64, allows the flange to be easily ruptured at the frangible line of weakness 64.

The location of the frangible lines of weakness 64 between adjacent projection segments 48*a* and 48*b* allows for the flange 38 to be ruptured therealong from a location above the projections 48*a* and 48*b*, to a location below the projections, without the necessity of tearing or rupturing through the projection itself. That is, the projection segments 48*a* and 48*b* increase the thickness of the flange thereat. Hence, were the projection 48 continuous about the periphery of the flange 38, it would be necessary in sectioning the flange 38 to tear through the thickened flange portion, which is more difficult than rupturing through a thinner flange. Since it is desirable for the rupturing of the flange 38 to be done easily, it is desirable to minimize the thickness of the flange 38 at the location at which the flange is to be fractured. By providing for a plurality of projection segments 48*a* and 48*b*, rather than a single, continuous annular projection 48, there are non-thickened sections in between the adjacent thickened projection sections 48*a* and 48*b*, with the frangible lines of weakness 64 residing in these non-thickened regions between adjacent projections. Hence, the flange 38 can be ruptured along the frangible lines of weakness 64 from a location above the projections 48 to a location below the projections 48, without the necessity of tearing directly through any of the projections 48, which would add undesirable increased resistance to tearing of the flange 38. The provision of an elongated frangible line of weakness 64, such as that of the preferred embodiment, which extends to nearly the lower edge 66 of the flange 38, reduces the force necessary to shear the flange 38 thereat.

In an alternative embodiment, the frangible lines of weakness 64 may not include the narrow lower portion 70, and may be comprised only of the recessed rectangular regions 72 provided in the upper portion of the peripheral flange 38. In this embodiment, illustrated in cross section in FIG. 11, the lower portion of the peripheral flange 38 is sheared by the downward force of a tool inserted through slot 76, even in the absence of the provision of a lower portion 70. The provision of the narrow lower portion 70 reduces the force necessary to shear the flange completely down to its lower edge 66. Cost savings may be realized by the elimination of the lower portion 70 of the lines of weakness 64.

It is desirable that the frangible lines of weakness 64 extend at least up to the groove 60, and extend sufficiently close to the lower edge 66 of the flange 38 to sever completely along a line from above the projection segments 48*a* and 48*b*, to the lower edge 66 of the flange 38. The frangible lines of weakness 64 are preferably formed in the molding process. That is, in the illustrated and preferred embodiment, the frangible lines of weakness 64 include both upper and lower portions 72 and 70 which are formed in the molding process, but in alternative embodiments the frangible lines of weakness 64 may not extend completely down to the lower edge 66 of the flange 38, and may include, for instance, only the upper recessed portion 72.

Based on the above discussion, the operation of the lid 20 of the present invention and its advantageous attributes should be apparent. Prior to opening a container 22, the lid 20 is engaged with the container 22 in the manner illustrated in FIG. 10, with the horizontal shoulder portions 50 of each of the retaining ring segments 48*a* and 48*b* bearing against the downwardly facing surface 56 of the annular bead 46 of the container 22 to secure the lid 20 tightly to the container 22. The lid is proportioned such that the gasket 58 which resides at the upper end of the channel 40 is compressed between the underside 54 of the ring 34 and the upper edge 26 of the container 22, which assures sealing of the contents in the container.

The flange 38 is initially continuous, extending peripherally about the upper edge 26 of the container 22. The projection segments 48*a* and 48*b* form a discontinuous band which requires considerable force to be moved past the annular bead 46 of the container. Hence, as shipped, the lid is fastened securely enough to the container that the lid and container assembly can withstand the dynamic forces associated with required industrial standardized drop tests, without spillage of the contents of the container. The lids are strong enough that they support 400 lbs. of weight when the container is filled so that lids will support a stack of filled containers thereabove. Such stacking occurs in warehousing or in shipping. In testing the lid and container assembly of the present invention, it was found capable of successfully surviving drops of four feet without spillage of the container contents or fracturing of the hinge lines 60.

To open the container 22, the peripheral flange 38 is ruptured at each of the frangible lines of weakness 64 to segment the flange 38 into a plurality of separate flange segments 38*a* and 38*b*. A screwdriver or the like is sequentially inserted into each of the slotted apertures 76 and pried outwardly with sufficient force to tear the peripheral flange 38 along the frangible line of weakness 64, to thereby segment the flange. Of course, a knife may be used to cut along the line of weakness rather than rupturing it with force from the screw driver. Each of the flange segments 38*a* and 38*b* is then pivoted upwardly to the disengaged or non-obstructing position (see FIG. 6). Once each of flange segments 38*a* and 38*b*, together with their respective integral projection segments 48*a* and 48*b*, have been pivoted upwardly to completely disengage the annular projection 48 from the annular bead 46, the lid 20 may be removed by simply overcoming the frictional force associated with the cylindrical surfaces of the flanges 36 and 38 engaging the upper end of the sidewall 24 of the container 22.

With large diameter containers, there is an extensive length along which the projection 48 bears against the container bead 46, requiring greater force to move the projection 48 upward past the container bead 46 than is required with lesser length projections. That is, the greater the length of engagement between the projection 48 and the bead 46, the greater the force required to move the projection 48 upward past the bead 46. Since, in accordance with the present invention, each of the flange segments 48*a* and 48*b* are pivotable independently, to move their respective integral projection segments 48*a* and 48*b* to disengaged, non-obstructing positions, it is only necessary to provide sufficient force to disengage one flange segment at a time. That is, a smaller force is necessary to move one of the flange segments 38*a* and 38*b* upward and to move its respective short projection ring segment 48*a* and 48*b* upward therewith past the container bead 46, as compared with a significantly greater force required to move a longer length of projection upward past the container bead 46. Hence, since, in accordance with the invention, the shorter lengths of the projection segments 48*a* and 48*b* can each be moved independently and sequentially to non-obstructing positions, it is not necessary to move two or more projection segments simultaneously past the container bead 46 in order to remove the lid, and hence it is not necessary to exert the greater force necessary to simultaneously disengage this greater projection length. This is in contrast with the aforementioned '337 patent in which lid removal requires the simultaneous camming outwardly of one-half of the projection retaining ring segments together with upward raising of the lid, thus requiring an application of a much greater force to effect lid removal than required with the lid 20 of the present invention.

Following the independent pivoting of each of the flange segments 38*a* and 38*b* to their disengaged winged positions, there are no remaining projection segments 48*a* or 48*b* engaging the container bead 46, so that the lid 20 may be removed from the container 22 with minimal force. In this regard it is important that all of the segments 38*a* and 38*b* of the annular projection 38 are moved to non-obstructing positions in which they are preferably retained by the over-center nature of the hinge sections connecting the segments to the flange 38, so that only the frictional forces need be overcome to remove the lid 20.

As indicated above, it is often desired to have the lid 20 adapted to reseal the container 17 if portions of the contents remain and are to be used in the future. If the lid 20 cannot adequately reseal the container, there will often be serious deterioration in the contents, and the contents may splash out of the container during transport. The plastic lids of the prior art have typically been either difficult to remove or to reseal, or both. In the lid of the present invention, the pivotability of each of the flange segments 38*a* and 38*b* to non-obstructing positions provides a lid which is easy to remove initially and easy to reseal and to again remove at a later time.

In returning the lid 20 to the container 22, the lid 20 is forced downwardly on the upper edge 26 of the container sidewall 24, with the flange segments 38*a* and 38*b* initially disposed outward. Thereafter, each of the flange segments 38*a* and 38*b* is independently and sequentially pushed further radially inwardly to an engaging position in which the respective projection ring retaining segment 48*a* and 48*b* are in retaining engagement with the container bead 46. The total lid retaining force provided by the engagement of each of the projection segments 48*a* and 48*b* with the container bead 46 is sufficient to prevent splashing and to hold the lid on the container. The flange segments do not fully return to their original unopened positions; the flange segments are engaged enough along the eight areas to hold the lid on to prevent splashing.

When it is desired to reopen the container, the flange segments 48*a* and 48*b*, each of which remains pivotally attached to the lid body 28, are again independently and sequentially pivoted upward to disengaged positions to allow easy removal of the lid. Thereafter, the lid 20 may again be reengaged with the container 22 by sequentially pivoting the flange segments downward into engagement with the container bead 46.

Because of the depth of the channel 40 and the friction to be overcome, it may be difficult to verify whether or not the upper edge 26 of the container 22 is seated against the gasket 58, and that a good sealing engagement has been obtained. That is, it may be difficult to verify whether or not the projection segment 48*a* or 48*b* has moved past the bead 46 and is engaged against the downwardly facing surface of the bead 56. The provision of a sharp step at the horizontal shoulder portion 50 of the projection 48 results in a snap sound upon proper engagement of the projection 48 with the bead 46, which informs a user that that particular flange segment has engaged properly and that he may move onto engaging the next flange segment 48*a* or 48*b*. Also, if the lid 20 is only slightly disengaged from the container bead 46, then the inwardmost tip of the projection 48 bears against the outwardmost tip of the container bead 46, resulting in that flange segment being angled slightly upwardly. This slight angling of a non-engaged flange segment should be apparent, and readily visually discernable, when a non-engaged flange segment is adjacent other properly engaged flange segments which are not angled outwardly. Hence, a user can readily push a flange segment further downwardly and inward to assure that the container lid has been properly sealed to the container rim.

The lid 20 of the present invention represents a significant advance in the closure art in solving the problems of providing a very easy opening lid for large size containers and for the resealing of the lid to large plastic containers such as five gallon paint containers. While resilient plastic lids have presented significant cost advantages over other types of metallic lids, there have been shortcomings in the prior art plastic lids in sealing, unsealing and resealing large diameter containers. The lid of the present invention's provision of having each of the segments of the lid flange moveable and retainable at non-obstructing positions is novel and significantly facilitates the lid removal.

Although the invention has been described in terms of a preferred embodiment of a five gallon lid for a five gallon paint container, it will be understood that there is no intent to limit the invention by such disclosure, but rather it is intended to cover lids for attachment to different and various sizes of containers and for packaging of contents other than paints. The present invention is intended to cover modifications and alternative constructions falling within the spirit and scope of the invention as defined in the appended claims.

What is claimed is:

1. A resilient plastic lid for use with a container having a sidewall terminating at an upper rim with an adjacent locking bead, the lid comprising;

a circular body portion;

a peripheral flange extending downwardly from the body portion and terminating at a lower edge;

a locking ring on said flange extending radially inwardly for engagement with said container bead when said body portion is in sealing engagement with said container rim;

frangible lines of weakness in said peripheral flange for being severed to form the peripheral flange into a plurality of separate flange segments extending about the circumference of the lid; and a hinge line on each of said separate flange segments for hinging its associated flange segment for pivoting radially outwardly away and upwardly from said container, following rupture of said flange along said frangible lines of weakness, to a release position allowing all of the separated flange segments and attached portions of the locking ring to be moved outwardly relative to the container bead to allow easy removal of the lid from the container;

each and every flange segment being pivotable upwardly to the release position leaving no flange segments engaging the container;

each hinge line comprising a thin hinge cross section in each of said flange segments positioned substantially above the locking ring to allow pivoting of the flange segments and portions of the locking ring thereon outwardly to the release position and, for resealing, pivoting downwardly into a retaining position to again engage the container bead to retain the lid on the container;

said frangible lines of weakness in said peripheral flange extending above the locking ring to adjacent the hinge lines to form separate flange segments hinged above the locking bead on the container; and each hinge line comprising a rounded groove in the interior of the peripheral flange and a rounded lower corner on the rounded groove to assist in stripping the lid from a mold.

2. A resilient plastic lid in accordance with claim 1 wherein each said flange segment has an interior surface and an exterior surface, and each said thin hinge cross section being a groove formed in an interior surface.

3. A resilient plastic lid for use with a container having a sidewall terminating at an upper rim with an adjacent locking bead, the lid comprising:

a circular body portion;

a peripheral flange extending downwardly from the body portion and terminating at a lower edge;

a plurality of peripherally spaced projection segments on said flange extending radially inwardly for engagement with said container bead when said body portion is in sealing engagement with said container rim, each of the projection segments terminating at opposite lateral ends which are separated by a space from an end of an adjacent projection segment;

frangible lines of weakness in said peripheral flange extending substantially vertically between each of the projection segments, said frangible lines of weakness defining a plurality of separate flange segments;

said flange segments being each formed with a thin hinge section defined by a groove spaced above the respective projection segments thereof to allow pivoting of the flange segments outwardly to the release position and downwardly into a retaining position to again engage the container bead to retain the lid on the container;

each of said vertically extending frangible lines of weakness being aligned with one of said spaced between adjacent lateral ends of adjacent projection segments to facilitate separating the flange into flange segments at locations above the projection segments;

each of said separate flange segments being deflectable outwardly away from aid container, following rupture of said flange along said frangible lines of weakness, to a release position in which said projection segments thereon are moved outwardly relative to the container bead to allow easy removal of the lid from the container.

4. A resilient plastic lid in accordance with claim 3 wherein said flange segments are self-biased to either of two stable positions, said release position and a sealing position against said container.

5. A resilient plastic lid in accordance with claim 3 wherein said projection segments each have an angled lower surface for bearing against said container bead upon engagement of said container with said lid to cam the respective projections outwardly and over said container bead, and said projection segments each have a flat upwardly facing surface for engaging the container bead to retain the lid on the container.

6. The plastic lid of claim 3 including, in combination therewith, a container having an upstanding sidewall, an upper rim edge on the sidewall, a locking bead on the sidewall for interlocking engagement with projection segments of the peripheral flange of lid.

7. A resilient plastic lid in accordance with claim 3 wherein said body portion is provided with a second depending flange spaced radially inwardly from said peripheral flange and positioned to sealingly engage the inner circumference of said rim, said second flange and said peripheral flange forming a downwardly facing annular channel to sealingly receive said container rim.

8. A resilient plastic lid in accordance with claim 7 wherein said body portion is formed of a circular disc connected by an upstanding flange to a concentric ring from which said peripheral and second flanges depend, a plurality of radially extending webs extending between said second flange and said body portion including said ring and said disc.

9. A resilient plastic lid in accordance with claim 7 wherein said peripheral flange and said second flange are proportioned to accommodate a gasket therebetween which forms a positive seal with said container rim when said lid is in sealing engagement with said container.

10. A resilient plastic lid in accordance with claim 3 wherein said flange has an interior surface and an exterior surface, and said thin hinge section comprises a groove formed in said interior surface of said flange.

11. A resilient plastic lid in accordance with claim 10 wherein said groove extends continuously about the periphery of the flange.

12. A resilient plastic lid in accordance with claim 10 wherein said groove is formed by a mold with the groove extending substantially perpendicular to the interior surface of the flange at its upper end tapering smoothly into the interior surface of the flange at its lower end to facilitate release from the mold.

13. A resilient plastic lid in accordance with claim 10 wherein said groove has a first radius of curvature over a first portion thereof and a second radius of curvature over a second portion thereof.

14. A resilient plastic lid in accordance with claim 13 wherein the interior surface of the peripheral flange in the region defined by said groove comprises a first concave portion and a second convex portion.

15. A resilient plastic lid for use with a container having a sidewall terminating at an upper rim with an adjacent locking bead, the lid comprising:

a circular body portion;

a peripheral flange extending downwardly from the body portion and terminating at a lower edge;

a plurality of peripherally spaced projection segments on said flange extending radially inwardly for engagement with said container bead when said body portion is in sealing engagement with said container rim, each of the projection segments terminating at opposite lateral ends;

frangible lines of weakness in said peripheral flange extending substantially vertically between each of the projection segments, said frangible lines of weakness defining a plurality of separate flange segments;

said flange segments being each formed with a thin hinge section positioned above the respective projection segments thereof to allow pivoting of the flange segments outwardly to the release position and downwardly into a retaining position to again engage the container bead to retain the lid on the container;

each of said separate flange segments being deflectable outwardly away from said container, following rupture of said flange along said frangible lines of weakness, to a release position in which said projection segments thereon are moved outwardly relative to the container bead to allow easy removal of the lid from the container;

said lines of weakness comprising an upper portion having a recess formed into the exterior surface of said peripheral flange, and a lower portion in communication with said upper portion and having a narrow, substantially vertically extending groove formed in the exterior surface of said peripheral flange.

16. A resilient plastic lid in accordance with claim 15 wherein said recessed upper portions include respective tool-receiving apertures which receive a leading end of a tool therein to facilitate rupture of the peripheral flange along said respective lines of weakness upon prying outward of said leading end of said tool.

* * * * *